US006550937B2

(12) United States Patent
Glass

(10) Patent No.: US 6,550,937 B2
(45) Date of Patent: Apr. 22, 2003

(54) LOUVERED SCREEN TO CONTROL LIGHT

(76) Inventor: Philip John Glass, 1143 E. 38th St., Erie, PA (US) 16504

( * ) Notice: Subject to any disclaimer, the term of this patent is extended or adjusted under 35 U.S.C. 154(b) by 0 days.

(21) Appl. No.: 09/851,816

(22) Filed: May 9, 2001

(65) Prior Publication Data

US 2002/0167809 A1 Nov. 14, 2002

(51) Int. Cl.[7] ..... F21V 11/02

(52) U.S. Cl. ..... 362/290; 362/342; 362/354; 362/812

(58) Field of Search ..... 362/290, 354, 362/342, 330, 812

(56) References Cited

U.S. PATENT DOCUMENTS

| | | | | | |
|---|---|---|---|---|---|
| 2,398,799 | A | * | 4/1946 | Miller | 362/290 |
| 3,368,070 | A | * | 2/1968 | Schwartz et al. | 362/354 |
| 3,940,896 | A | * | 3/1976 | Steel | 362/354 |
| 6,238,065 | B1 | * | 5/2001 | Jones | 362/354 |

* cited by examiner

*Primary Examiner*—Stephen Husar
(74) *Attorney, Agent, or Firm*—Richard K. Thomson

(57) ABSTRACT

A transparent base panel has embedded therein a series of uniformly, sized, shaped and spaced louvers that extend outwardly from the base panel at an angle β, to optimize light flowing in a direction from an inner surface toward an outer surface while minimizing an amount of light flowing from the outer surface to the inner surface. This louvered screen has application in making outdoor illuminated signs more readable, in screening sunlight out of a compartment such as a room, and in deflecting and/or tinting light from a direct or indirect lighting source.

19 Claims, 5 Drawing Sheets

LOUVERED SCREEN TO CONTROL LIGHT

BACKGROUND AND SUMMARY OF THE INVENTION

The present invention is directed to a louvered screen for controlling light. The screen is particularly useful in 1) making illuminated outdoor signs more readable and also has utility in 2) screening sunlight out of compartments and, 3) direct and indirect lighting applications.

Illuminated signs and signals have numerous outdoor applications from traffic control to advertising. In direct sunlight, these signs are often misinterpreted: at times the sunlight washes out the sign preventing it from being read, at other times, it will make a sign that is not illuminated appear to be on, e.g., an "open" or "closed" sign for a bank drive-thru window. Various grates, typically metal, have been devised to try to address this problem with limited levels of success. These grates are also subject to having the vanes bent as a result of impact which can obscure the sign. In addition, the vertical vanes of the metal grates also cover the sign and are not aesthetically pleasing.

Other problems that the present invention can address include the provision of a sunscreen for compartments such as toll booths, for example. The louvered screen of the present invention can deflect the sun's rays while permitting the booth attendant to see out. In another application, the louvered screen of the present invention can be used to soften and/or direct the light emanating from direct or indirect lighting elements.

The present invention provides a louvered screen in which a base plate of transparent plastic has embedded therein a first end of each of a series of equally, spaced, identical height louvers which extend outwardly from the base plate at an angle $\beta$ other than 90°. The size of the angle $\beta$ and the length of the louver, will be application driven, i.e., the desired angle and the distance the louver projects from the base, will depend on how the screen is to be used. The angle $\beta$, for sunlight blocking applications, will depend on and typically be equal to the viewing angle. The length of the louver is designed, in conjunction with said angle $\beta$, to optimize light flowing in a direction from said inner surface toward said outer surface while minimizing an amount of light flowing from said outer surface to said inner surface. While this is true for all applications, it is more important for some than for others (e.g., the sign over the lighting application). For applications involving sunlight screening, the angle $\beta$ will be in the range between 20° and 50°. Most preferably, the angle $\beta$ is 31° for sign screening applications involving overhead signs. For direct and indirect lighting applications, the angle $\beta$ may vary between 10° and 80° depending on the desired lighting effect.

For applications where sunlight is involved, there is an angle $\alpha$ at which the sun is low enough in the sky that it has adequate abatement from the atmosphere and ceases to be a factor. Accordingly, the angle $\alpha$ is built into the louvered screen comprising the angle measured from a point tangent to the base of a first slat to a point tangent to the outer end of the preceding slat. For other applications, the angle $\alpha$ is the angle at which direct viewing of the light source is obscured. Adjacent ends of louvered screen panels are configured to enable them to be easily snapped together (e.g., by a dovetail and groove, for example) to permit coverage of a larger area.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
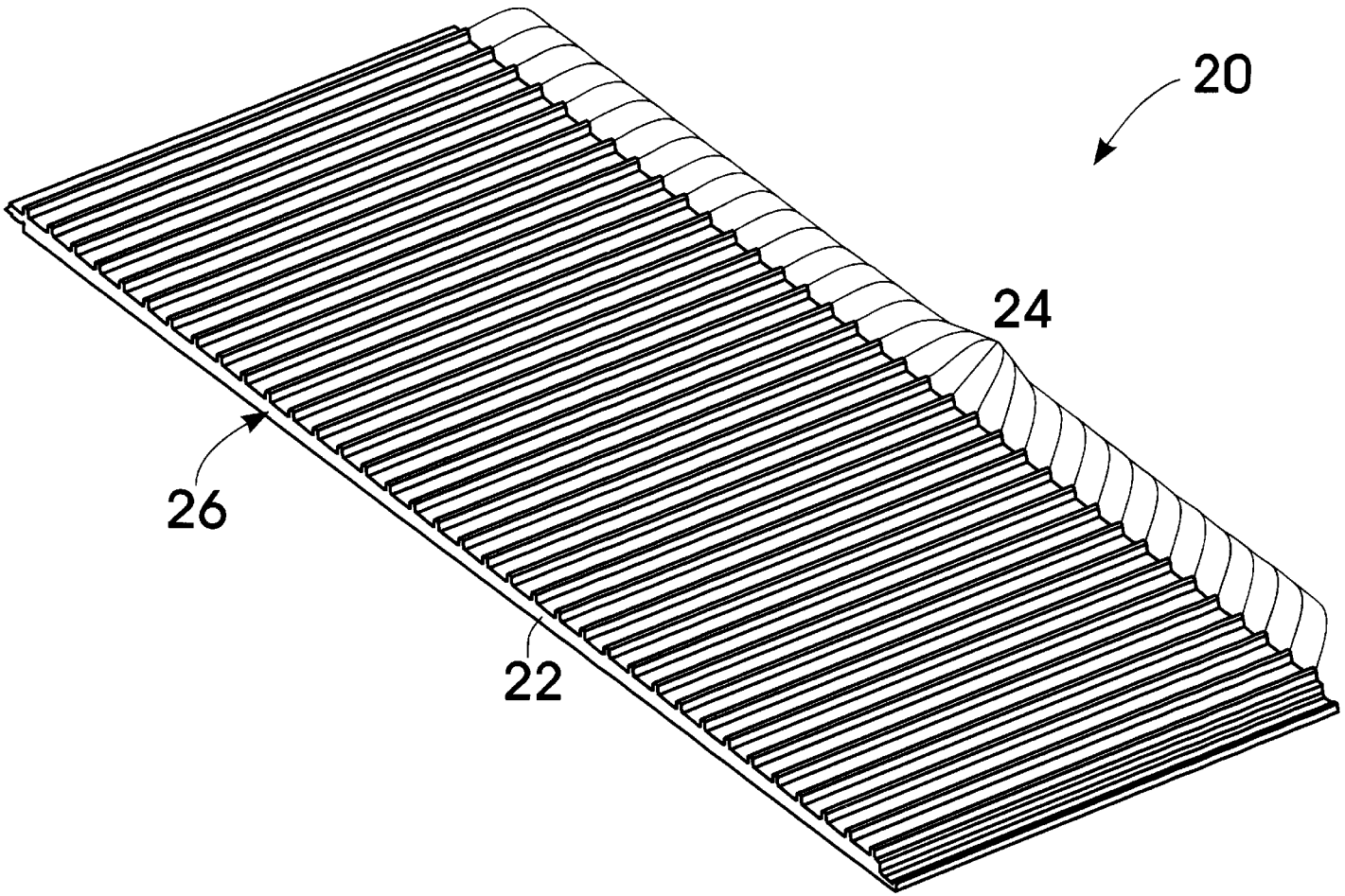
FIG. 1 is a perspective view of a first embodiment of the louvered screen of the present invention.
Figure 2:
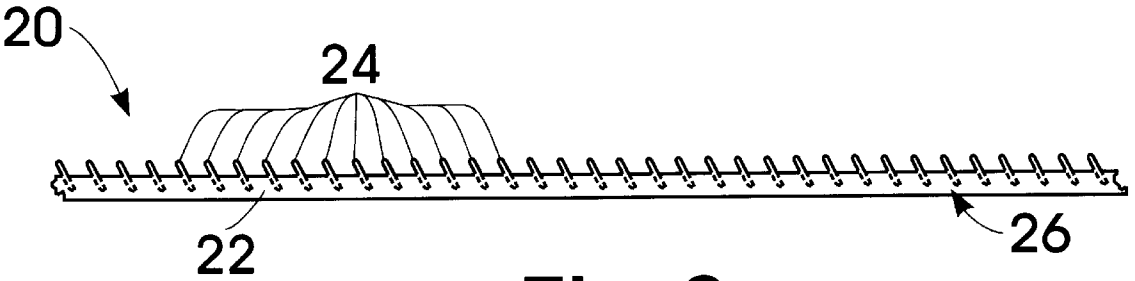
FIG. 2 is a side view of the first embodiment of the louvered screen.
Figure 3:
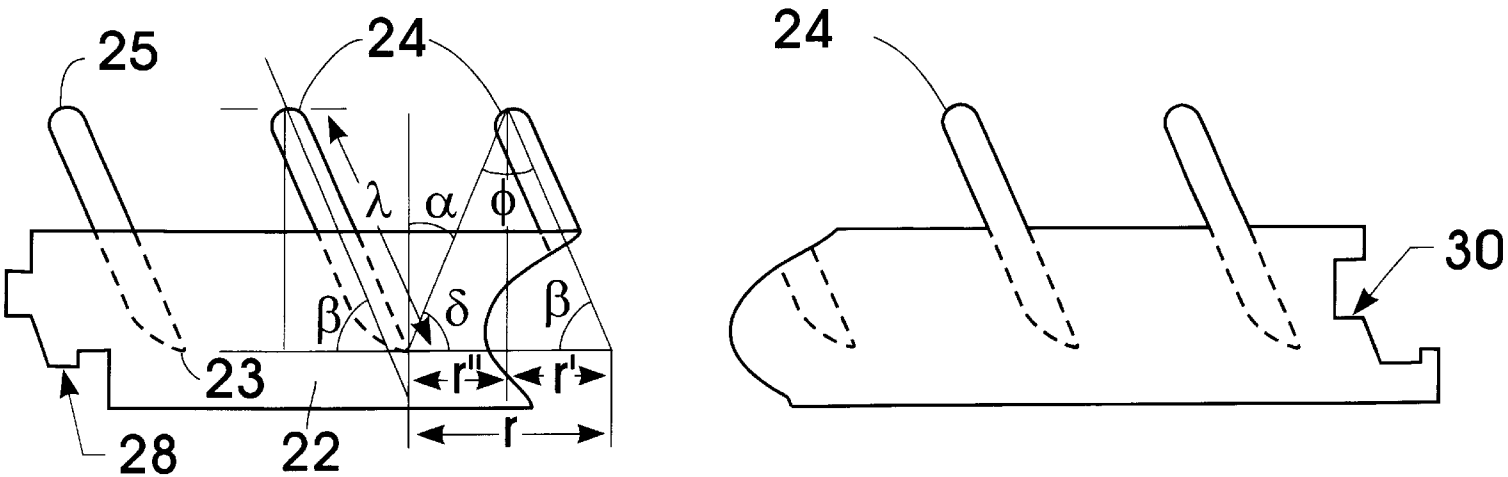
FIG. 3 is a detailed side view of the first embodiment.

A first embodiment of the louvered screen of the present invention is shown in FIGS. 1–3 generally at 20. Louvered screen 20 comprises a base 22 of clear plastic material with a series of uniformly sized, shaped and spaced louvers 24 at least partially embedded therein. Louvers 24 are made of an opaque plastic, preferably black for most applications, that controls the light flowing inwardly and outwardly through the screen 20. Each louver 24 has a tapered end 23 that enhances the transmission of light in a direction from below base 22 toward outer end 25 of the louver 24. Both the base 22 and louvers 24 are preferably made of the same highly durable plastic material such as, for example, an acrylic, specifically polymethyl methacrylate, being co-extruded into a panel 26. Louvers 24 each form an angle $\beta$ other than 90° with base 22, the precise angle being application driven. For applications involving the screening out of sunlight, $\beta$ will typically lie in the range of between 20° and 50°. For general lighting applications, $\beta$ may lie in a broader range of between 10° and 80° depending on the desired lighting effect. The length $\lambda$ of each louver 24 is also application driven as will be discussed in greater detail. It will be appreciated that for sunlight blocking applications, the louvers are preferably made of opaque plastic tinted black to minimize the flow of light into the panel. However, for lighting applications, it may be desirable to make the louvers of a translucent or transparent plastic with colors so as not only to direct the light but to also tint the light emanating through the panel 26.

A third application driven parameter used in designing panel 26 is a second angle a. Generically, the angle $\alpha$ is the angle at which visibility of the base 22 is obscured by the louvers 24. For applications involving the screening out of sunlight, the angle $\alpha$ is selected as the angle at which the sun is low enough in the sky to be sufficiently dissipated by virtue of having to pass through a greater amount of atmosphere so as no longer to have an impact on readability of illuminated signs. For lighting applications, $\alpha$ is selected to be the angle at which viewing of the light is obscured by the louvers 24. This angle $\alpha$ is defined by a line drawn tangent to the base 23 of one louver 24 and the outward end 25 of the preceding louver 24. To fully characterize a particular panel 26, a number of parameters must be defined.

L=length of panel 26 r=spacing between louvers 24 t=thickness of louver 24 h=vertical height of louver 24 (i.e., projection of louver length $\lambda$ on a plane orthogonal to base 22)

N=total number of louvers 24

Once the angles α and β have been chosen, the balance of the geometry is defined, given the principle that the thickness t of louver 24 should be at least 20% of its height h. For this example, t will be selected to be 20% of h or t=0.2h All the other parameters will be set forth in terms of the relationship to the height h as well.

$$\delta=90°-\alpha$$

$$\phi=180°-\delta-\alpha$$

$$r=r'+r''$$

$$\tan\beta=h/r' \text{ therefore } r'=h/\tan\beta$$

$$\tan\delta=h/r'' \text{ therefore } r''=h/\tan\delta$$

Accordingly, $$r=h/\tan\beta+h/\tan\delta$$

Now that r has been defined as a function of h, the other variables may be solved for as well.

L=N (t+r) or in the length L is typically a given for a particular application, then N may be solved for:

$$N=L/(t+r)=L/[(0.2h)+(h/\tan\beta+h/\tan\delta)]$$

Figure 4:
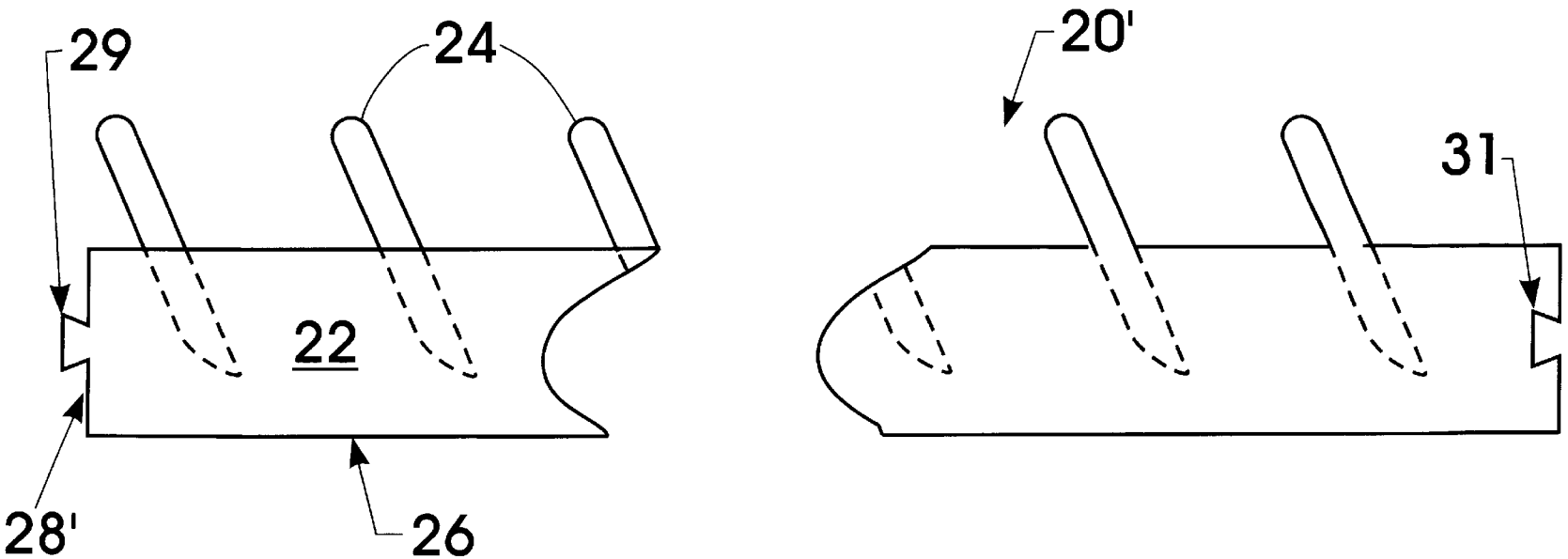
FIG. 4 is a detailed side view of a second embodiment.

FIG. 3 depicts one type of interface between first end 28 and second end 30 of an adjacent panel in which end 28 merely overlies end 30. However, a more preferred embodiment is depicted in FIG. 4 in which end 28' is formed with a dovetail 29 and end 30' with a dovetail slot 31. While both the dovetail 29 and dovetail slot 31 have been shown with exaggerated angularity, the angles will actually be gentle enough to permit the two sections to be axially snapped together. The dovetail 29 in slot 31 will keep adjacent sections together and prevent their inadvertent separation.

Figure 5:
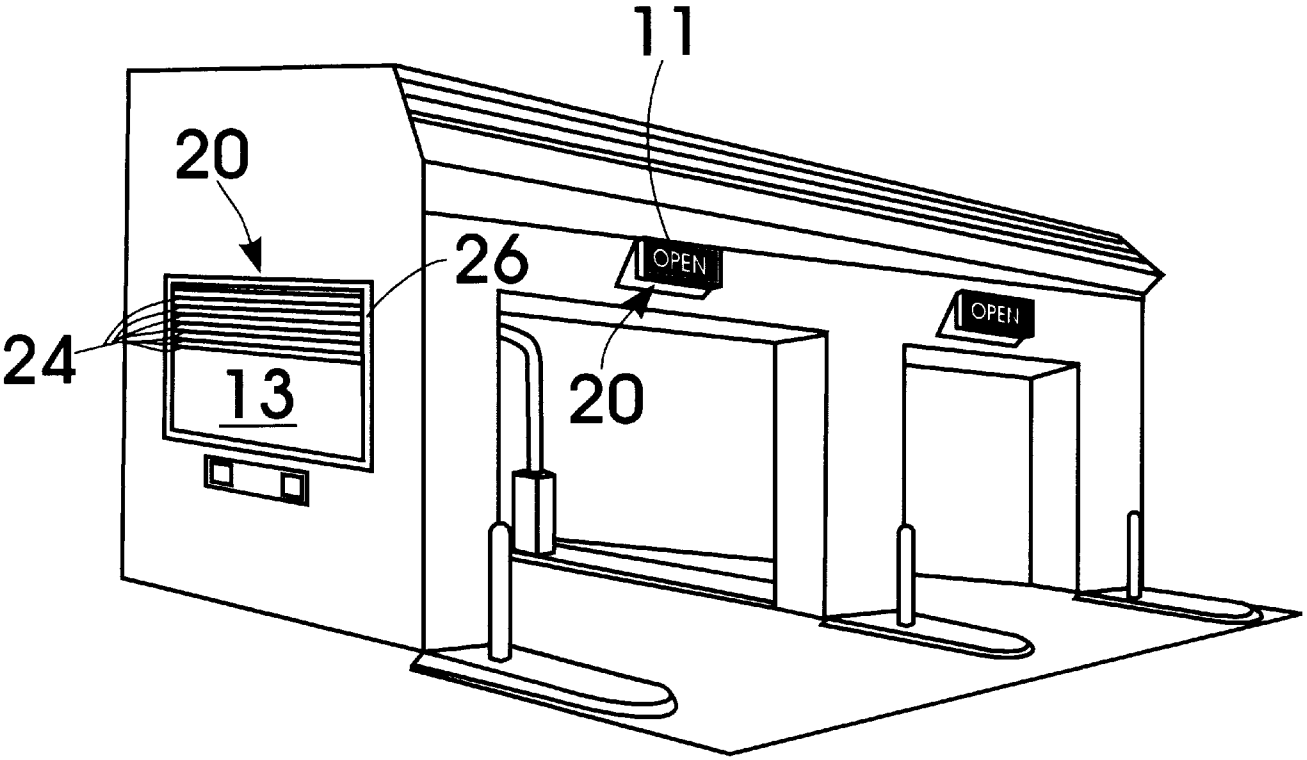
FIG. 5 is a perspective view showing two applications of the present invention.
Figure 6:
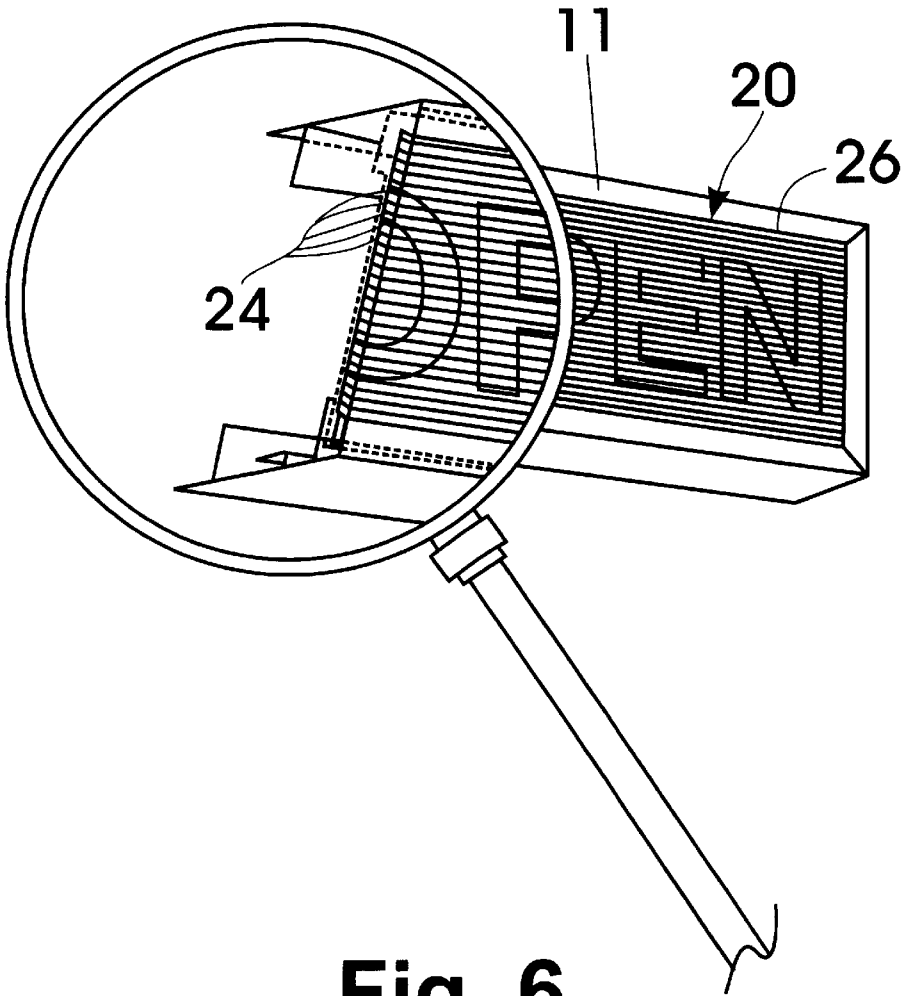
FIG. 6 is a detailed perspective view showing in the sign application in greater detail.

FIG. 5 shows two uses of the louvered screen 20 of the present invention: a first application in which the panel 26 is positioned in front of an illuminable sign 11. As shown in greater detail in FIG. 6, louvers 24 will keep direct sunlight from washing out the message displayed on sign 11 making it difficult to read or causing the sunlight to reflect off the light panel of sign 11 when it is not illumined making it appear that the sign is, in fact, on. The second application depicted in FIG. 5 is the use of panel 26 as a screen in window 13. As depicted therein, panel 26 is only positioned on the upper portion of window 13 to reduce the glare, in lieu of an awning, for example. It may be desirable to cover the entire window using louvers 24 in lieu of blinds. While it is anticipated that louvered screen 20 will find usage most readily in small compartments such as toll booths with little or no air conditioning, screen 20 can also be used in other window treatments in lieu of shades keeping out the heating rays and glare of the sun while permitting some light in and visibility outwardly. Such application should reduce the burden on the cooling system by reducing solar heating through the windows in summer.

As mentioned earlier, the panels 26 can be used in lighting applications by simply positioning a panel in front of a light source such as florescent bulbs, for example. The louvers 24 serve to diffuse the light or provide the most desirable deflection of the light rays if, for example, it is desired to deflect light onto a painting or hearth. As also mentioned, the use of transparent or translucent louvers 24 having a desired color can tint the light to provide a desired atmosphere. Panels 26 featuring the louvered screen 20 of the present invention can be purchased from Signal Tech of Erie, Pa. bearing the trademark ZERON.

Figure 7:
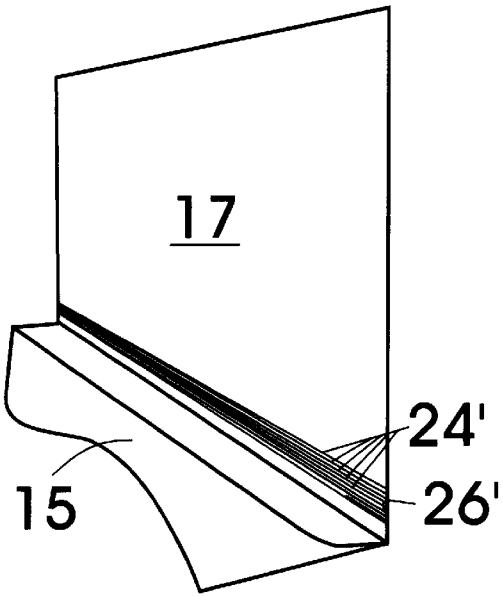
FIG. 7 is a perspective view of the louvered screen used in a safety lighting application.

FIG. 7 shows elongated panel 26' used to deflect emergency floor lighting onto the floor 15. Louvers 24' mask the emergency lights from view and may be colored to blend with the wall treatment 17 in which the light is mounted. In the event of a power outage, emergency lights will be activated and the louvered screen panel 26' will distribute the light across the floor 15 to facilitate exiting the facility.

Various alternatives, changes or modifications will become apparent following a reading of the foregoing specification. It is intended that all such alternatives, changes and modifications following within the scope of the appended claims be considered part of the present invention.

I claim:

1. A louvered screen for controlling light comprising:

a) a base plate of transparent plastic having a smooth inner surface and outer surface;

b) a plurality of equally spaced louvers made of opaque plastic material each having a first end embedded in said base plate and a second end extending outwardly from said outer surface of said base plate at an angle β other than 90°, each said louver having an identical length designed, in conjunction with said angle β, to optimize light flowing in a direction from said inner surface toward said outer surface while minimizing an amount of light flowing from said outer surface to said inner surface.

2. The louvered screen of claim 1 further comprising first interconnection means on a first end of said base plate and a second interconnection means on a second end of said base plate whereby said first and second interconnection means may be snapped together to interlock them providing a louvered screen capable of covering a larger area.

3. The louvered screen of claim 1 wherein said angle β lies in a range between 20° and 50°.

4. The louvered screen of claim 1 wherein said downwardly extending angle β is substantially 31°.

5. The louvered screen of claim 1 further comprising an angle α formed by drawing a line tangent to a base portion of a first louver and an outermost portion of a preceding louver, said angle α defining an angle at which visibility of said base is obscured by said louvers.

6. A louvered screen for use in directly viewing an illuminable sign comprising:

a) a base plate of transparent plastic having a smooth inner surface and an outer surface;

b) a plurality of equally spaced louvers made of opaque plastic material each having a first end embedded in said base plate and a second end extending outwardly from said outer surface of said base plate at a downwardly extending angle β other than 90°, each said louver having an identical length designed, in conjunction with said downwardly extending angle β, to optimize light flowing in a direction from said inner surface toward said outer surface while minimizing an amount of light flowing from said outer surface to said inner surface;

whereby the sun light does not washout the illuminable sign when it is energized nor make the sign appear lit when it is not.

7. The louvered screen of claim 6 further comprising first interconnection means on a first end of said base plate and a second interconnection means on a second end of said base plate whereby said first and second interconnection means may be snapped together to interlock them providing a louvered screen capable of covering a sign having a larger surface area.

8. The louvered screen of claim 6 wherein said downwardly extending angle β lies in a range between 20° and 50°.

9. The louvered screen of claim 7 wherein said downwardly extending angle β is substantially 31°.

10. The louvered screen of claim 6 further comprising an angle α formed by drawing a line tangent to a base portion of a first louver and an outermost portion of a preceding louver, said angle α defining an angle at which visibility of said base is obscured by said louvers wherein α is equal to an angle at which sunlight is sufficiently dissipated by the atmosphere so as no longer to have an impact on readability of illuminated signs.

11. A louvered screen for controlling light transmitted from a light source comprising:

a) a base plate of transparent plastic having a smooth inner surface and an outer surface;

b) a plurality of equally spaced louvers made of opaque plastic material each having a first end embedded in said base plate and a second end extending outwardly from said outer surface of said base plate at an angle β other than 90°, each said louver having an identical length, said louvered screen functioning to direct the light transmitted from the light source in a particular desired direction while minimizing light transmitted in at least one other direction.

12. The louvered screen of claim 10 further comprising first interconnection means oil a first end of said base plate and a second interconnection means on a second end of said base plate whereby said first and second interconnection means may be snapped together to interlock them providing a louvered screen capable of covering a larger area.

13. The louvered screen of claim 10 wherein said angle β lies in a range between 10° and 80°.

14. The louvered screen of claim 10 further comprising an angle α formed by drawing a line tangent to a base portion of a first louver and an outermost portion of a preceding louver, said angle α defining an angle at which visibility of said base is obscured by said louvers.

15. A louvered screen for controlling light entering an enclosure comprising:

a) a base plate of transparent plastic having a smooth inner surface and an outer surface;

b) a plurality of equally spaced louvers made of opaque plastic material each having a first end embedded in said base plate and a second end extending outwardly from said outer surface of said base plate at a downwardly extending angle β other than 90°, each said louver having an identical length designed, in conjunction with said downwardly extending angle β, to optimize light flowing in a direction from said inner surface toward said outer surface while minimizing an amount of light flowing from said outer surface to said inner surface;

whereby the sun light entering the enclosure is restricted.

16. The louvered screen of claim 15 further comprising first interconnection means on a first end of said base plate and a second interconnection means on a second end of said base plate whereby said first and second interconnection means may be snapped together to interlock them providing a louvered screen capable of covering a sign having a larger surface area.

17. The louvered screen of claim 15 wherein said downwardly extending angle β lies in a range between 20° and 50°.

18. The louvered screen of claim 15 wherein said downwardly extending angle β is substantially 31°.

19. The louvered screen of claim 15 further comprising an angle α formed by drawing a line tangent to a base portion of a first louver and an outermost portion of a preceding louver, said angle α defining an angle at which visibility of said base is obscured by said louvers wherein α is equal to an angle at which sunlight is sufficiently dissipated by the atmosphere so as no longer to have an impact on readability of illuminated signs.

* * * * *